US010772431B2

(12) United States Patent
Kusch

(10) Patent No.: US 10,772,431 B2
(45) Date of Patent: Sep. 15, 2020

(54) SEAT SHELL HAVING A SHAPED ONE-PIECE WOODEN SHELL

(71) Applicant: Kusch + Co. GmbH & Co. KG, Hallenberg (DE)

(72) Inventor: Dieter Kusch, Hallenberg (DE)

(73) Assignee: Kusch + Co. GmbH & Co. KG, Hallenberg (DE)

( * ) Notice: Subject to any disclaimer, the term of this patent is extended or adjusted under 35 U.S.C. 154(b) by 28 days.

(21) Appl. No.: 16/037,794

(22) Filed: Jul. 17, 2018

(65) Prior Publication Data

US 2019/0281987 A1 Sep. 19, 2019

(30) Foreign Application Priority Data

Mar. 14, 2018 (DE) ..... 10 2018 002 048

(51) Int. Cl.
*A47C 5/14* (2006.01)
*A47C 7/16* (2006.01)
(Continued)

(52) U.S. Cl.
CPC ..... *A47C 5/14* (2013.01); *A47C 3/12* (2013.01); *A47C 7/16* (2013.01); *A47C 7/24* (2013.01);
(Continued)

(58) Field of Classification Search
CPC ..... A47C 5/14; A47C 7/16; A47C 11/005
(Continued)

(56) References Cited

U.S. PATENT DOCUMENTS 2,541,835 A * 2/1951 Eero ..... A47C 5/12 297/411.41
3,295,890 A * 1/1967 Gore Murdoch ..... A47C 5/00 297/451.5
(Continued)

FOREIGN PATENT DOCUMENTS

CN 2533993 Y 2/2003
DE 867740 C 2/1953
(Continued)

OTHER PUBLICATIONS

European Search Report dated Apr. 25, 2019 in European patent Application No. 19000122.2, no English translation available, all pages.
(Continued)

*Primary Examiner* — David R Dunn
*Assistant Examiner* — Tania Abraham
(74) *Attorney, Agent, or Firm* — Kilpatrick Townsend & Stockton LLP

(57) ABSTRACT

A seat shell includes a one-piece shaped wooden shell which has a seat part and a backrest part and which in its transition region has a bent portion bent along a bending axis. The shaped wooden shell has a veneer structure including at least nine wood layers glued on top of each other. The wood layers include a top layer at each of the front and rear of the shaped wooden shell, respectively, the top layer made of a wood layer is arranged in the longitudinal direction. The wood layers also include between the top layers a number of middle and outer wood layers arranged in the longitudinal or transverse direction. The shaped wooden shell is upholstered, and has a transversely extending cutout defined by bars at the edge in the transition region and/or the backrest part.

22 Claims, 4 Drawing Sheets

(51) Int. Cl.

| | |
|---|---|
| ***A47C 7/24*** | (2006.01) |
| ***A47C 11/00*** | (2006.01) |
| ***A47C 3/12*** | (2006.01) |
| ***B27D 1/06*** | (2006.01) |
| ***B27D 1/08*** | (2006.01) |

(52) U.S. Cl.
CPC ..... *A47C 11/005* (2013.01); *B27D 1/06* (2013.01); *B27D 1/08* (2013.01)

(58) Field of Classification Search
USPC ..... 297/452.14, 452.15
See application file for complete search history.

(56) References Cited

U.S. PATENT DOCUMENTS 3,700,282 A * 10/1972 Rowland ..... A47C 4/02 297/440.23
3,970,497 A * 7/1976 Glover ..... B27D 1/04 156/182
4,529,247 A * 7/1985 Stumpf ..... A47C 3/026 297/285
5,288,131 A * 2/1994 Singley ..... A47C 5/14 297/452.24
5,411,316 A * 5/1995 Lovegrove ..... A47C 5/12 297/452.15
5,431,479 A * 7/1995 Leib ..... A47C 11/005 297/232
5,976,664 A * 11/1999 Lohmeyer ..... A47C 7/024 297/445.1
8,647,749 B2 * 2/2014 Norling ..... B27D 1/04 428/537.1
D845,691 S 4/2019 Weller

FOREIGN PATENT DOCUMENTS

| | | | |
|---|---|---|---|
| DE | 2013169 | A1 | 10/1971 |
| DE | 2353023 | A1 | 4/1975 |
| DE | 4316057 | A1 | 11/1994 |
| EP | 0130229 | A1 | 1/1985 |
| FR | 1101033 | A | 9/1955 |

OTHER PUBLICATIONS

German Examination Report dated Aug. 28, 2019 in German Patent Application No. 102018002048.8, all pages. Google translation provided.

* cited by examiner

SEAT SHELL HAVING A SHAPED ONE-PIECE WOODEN SHELL

CROSS-REFERENCE TO RELATED APPLICATIONS

This application claims priority to German Patent Application No. 10 2018 002 048.8, filed Mar. 14, 2018, the disclosure of which is incorporated by reference herein in its entirety.

The invention relates to a seat shell comprising a shaped one-piece wooden shell which has a seat part and a backrest part.

A one-piece seat shell with a backrest part and a seat surface is known from DE 43 16 057 A1. The known seat shell consists of a sprung material in order to permit an adaptability of the backrest part of the seat shell, which is required for comfortable seating. As a result, when subjected to load by a person leaning against the backrest, said backrest of the seat shell is able to pivot slightly, wherein the supporting effect of the seat shell should nevertheless have sufficient stability in the region of the spinal column of the person.

The known seat shell is a shaped wooden panel comprising a plurality of wood layers glued crosswise on top of each other. The seat shell may be surface-finished with a suitable coating or provided with upholstery. A lacquered seat shell has the following veneer structure. It comprises a top layer being a wood layer in the longitudinal direction which is glued to a transverse layer, wherein the longitudinal layer is ground before being pressed. Such a top layer is arranged on both sides of the seat shell. Two longitudinal veneers which are glued together are located on both sides between the top layers and a transverse layer is provided in the neutral zone of the shell. The longitudinal layers preferably have a thickness of 1.5 mm and the transverse layers have a thickness of 1.1 mm.

A shell, which is fully upholstered, preferably consists of two longitudinal veneers, a transverse veneer, two longitudinal veneers, a transverse veneer and two longitudinal veneers, wherein the longitudinal veneers have a thickness of 1.5 mm and the transverse veneers have a thickness of 1.1 mm.

Arched-shaped cuts are provided in the backrest part of such a seat shell in order to increase the flexibility of the shell. When the backrest part is subjected to load by a person leaning against the backrest part, the segments bordered by the cuts are spread and protrude in the manner of scales.

A disadvantage is that the level of seating comfort is insufficient for comfortable seating.

In particular, the protrusion of segments in the manner of scales leads to undesirable compression of the upholstery.

It is, therefore, an object of the invention to provide a seat shell, which has a good level of flexibility for comfortable seating and at the same time sufficiently supports the spinal column when a person leans back.

This object is achieved by the features of claim 1.

According to embodiments of the invention a seat shell is provided comprising a shaped one-piece and/or single wooden shell which has a seat part, a backrest part and a curved transition region connecting the seat part and the backrest part. Such a shaped wooden shell is preferably shaped ergonomically and may be fixed individually or in any number to a frame. The suspension properties of the backrest part relative to a seat part, which is angled back and connected to the backrest part, are substantially determined by the curved transition region and the structural design thereof.

According to embodiments of the invention, there is provided a shaped wooden shell comprising a transversely extending cutout bordered by bars at the edge in the transition region and/or the backrest, upholstery being provided around said cutout that is designed as an opening or horizontal slot. The opening is advantageous for providing a clearing effect for objects deposited on the seat, such as for example beverage cans, which are able to drop down via the opening which acts as a reach-through hole. Inadvertently sitting on movable objects is substantially avoided thereby. Moreover, a ventilation effect is produced which improves the seating comfort.

Further, according to the invention, the spring effect is improved combined with the cutout by a veneer structure which comprises at least nine wood layers and which in the center defines a type of sandwich structure by at least two middle wood layers in the transverse direction, at least one middle wood layer in the longitudinal direction being arranged therebetween and the at least two middle wood layers in the transverse direction having a greater thickness than outer wood layers in the transverse direction. The at least two middle wood layers in the transverse direction of greater thickness increase the overall structure and the stiffness of the shell such that the cutout is bridged, whereby however the outer wood layers are more distanced from the core and thus are subjected to greater tensile and compressive loads. This may be compensated by outer wood layers in the transverse (width) direction and the longitudinal (length) direction.

The veneer structure according to the invention provides an upholstered seat shell with a comparable level of seating comfort together with flexibility, irrespective of whether the cutout is free standing or covered by padding. A seat may be provided to a user with substantially the same seating comfort, with a variable appearance—with or without a reach-through hole. This also applies when the seat shell is subjected to high loads due to use.

Further embodiments of the invention may be derived from the following description and the dependent claims.

The invention is described in more detail hereinafter with reference to the exemplary embodiments shown in the accompanying illustrations.

Figure 1:
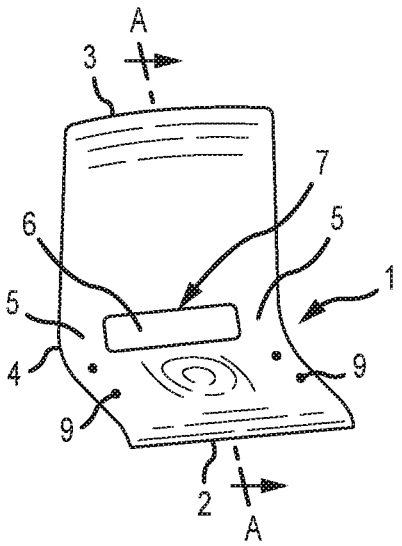
FIG. 1 shows schematically a front view of a shaped wooden shell with a cutout for a seat shell according to the invention, according to a first exemplary embodiment.
Figure 2:
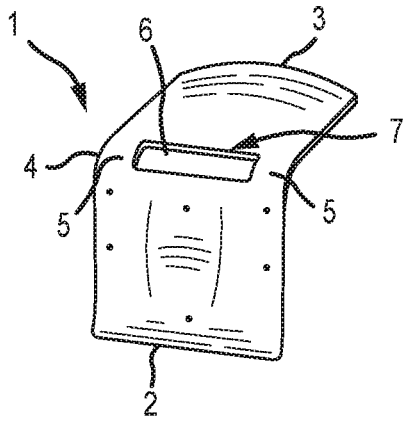
FIG. 2 shows schematically a rear view of the shaped wooden shell according to FIG. 1.
Figure 3:
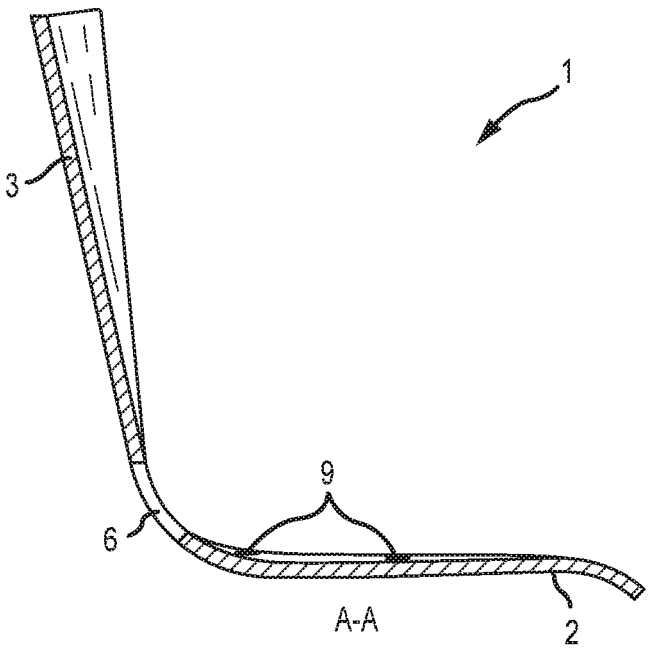
FIG. 3 shows schematically a longitudinal section of the shaped wooden shell according to FIG. 1.

As shown in FIG. 1 to FIG. 3, the invention relates to a seat shell having a one-piece shaped wooden shell 1. The shaped wooden shell 1 is configured with a seat part 2 and a backrest part 3, said shaped wooden shell in its transition region 4 having a bent portion along a bending axis. The backrest part 3 may have a contour adapted to the spinal column of a human.

The shaped wooden shell 1 has a veneer structure comprising a plurality of wood layers 10 to 15 glued on top of each other (laminated), as is described hereinafter with reference to FIG. 7 to FIG. 10 in detail.

This veneer structure comprises at the front and rear of the shaped wooden shell 1 a top layer 15, respectively, being a wood layer in the longitudinal direction. Between the top layers 15 a number of middle and outer wood layers 10 to 14 in the longitudinal or transverse direction are arranged. The shaped wooden shell 1 is upholstered as described hereinafter.

The shaped wooden shell 1 has a cutout 6 extending transversely and defined by bars 5 at the edge, said cutout being configured in the transition region 4 and/or the backrest part 3. According to the first exemplary embodiment shown in FIG. 1 to FIG. 3, the cutout 6 is configured as an opening which preferably extends in the backrest part 3 for forming, for example, a reach-through hole. Therefore the cutout 6 is preferably configured as a rectangular opening 7 with a length which is 50 to 70% of the shell width in the region of the cutout 6. The cutout 6 may have a width which is 20 to 40% of the length of the cutout 6. When the shaped wooden shell 1 is upholstered to build up the seat shell, such a cutout 6 is preferably surrounded by upholstery so as to remain open and thus remains as a free space in the upholstery.

Figure 4:
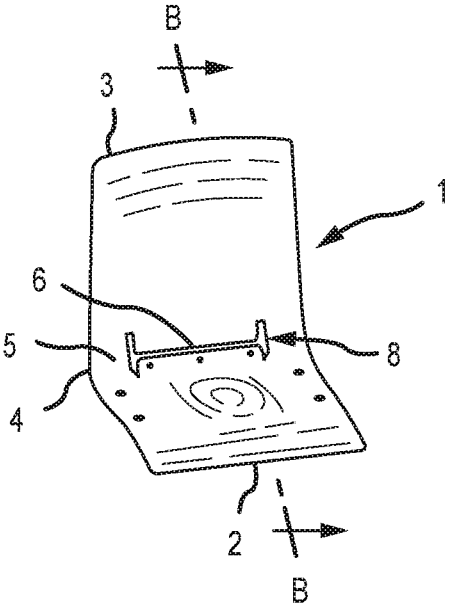
FIG. 4 shows schematically a front view of a shaped wooden shell with a cutout for a seat shell according to the invention, according to a second exemplary embodiment.
Figure 5:
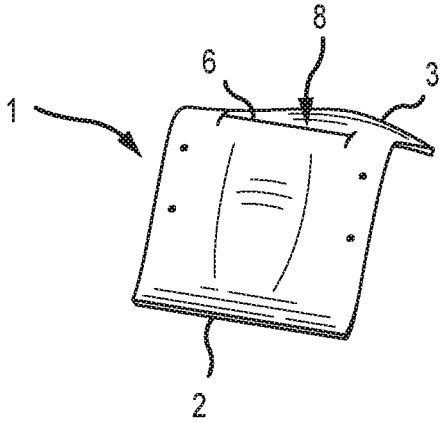
FIG. 5 show schematically a rear view of the shaped wooden shell according to FIG. 4.
Figure 6:
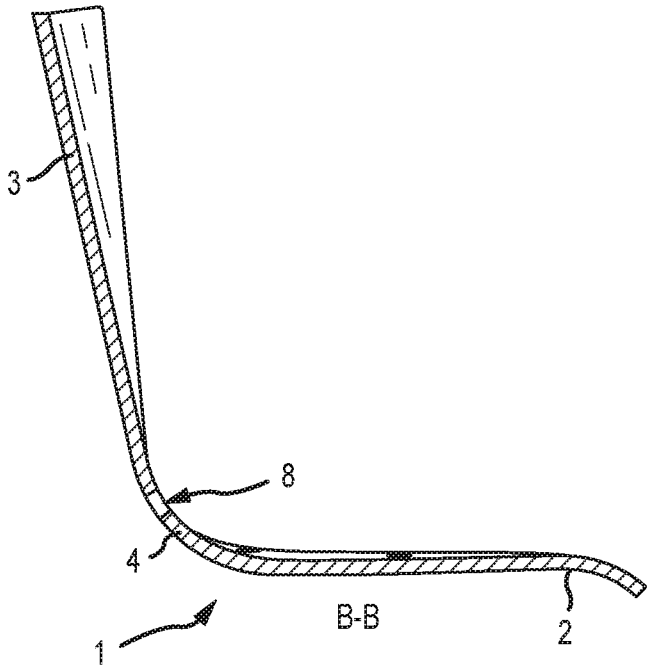
FIG. 6 shows schematically a longitudinal section of the shaped wooden shell according to FIG. 4.

FIG. 4 to FIG. 6 show a second exemplary embodiment with a cutout 6 which may be covered by the padding when the shaped wooden shell 1 is continuously upholstered. The cutout 6 is preferably formed by a double T-bar-shaped transverse slot 8. The contour of such a transverse slot 8 is similar to the contour of a rectangular opening 7, whereby comparable material recesses (for covered or non-covered cutout 6) are formed in the core of the shaped wooden shell 1 with similar effects on the flexibility of the structure of the shaped wooden shell 1 when subjected to load. The position of the cutout 6 in the structure of the shaped wooden shell 1 is preferably the same for the rectangular opening 7 or the transverse slot 8.

In the seat part 2, fastening holes 9 may be provided for attaching brackets (not shown) for a base or pedestal (not shown).

The veneer structure comprises at least nine wood layers 10 to 15, with at least two middle wood layers 11 in the transverse direction, at least one middle wood layer 10 being arranged therebetween in the longitudinal direction and the at least two middle wood layers 11 in the transverse direction having a greater thickness than the outer wood layers 14 in the transverse direction and/or optionally the outer wood layers 12, 13, 14 in the longitudinal direction.

Figure 7:
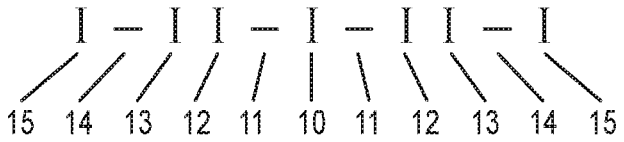
FIG. 7 to FIG. 10 show in each case a veneer layer structure in different designs, wherein the sign (I) indicates a longitudinal wood layer and the sign (–) indicates a transverse wood layer.

At least two outer wood layers 12, 13 in the longitudinal direction which are glued on top of each other may be located between a middle wood layer 11 in the transverse direction and an outer wood layer 14 in the transverse direction, as shown in FIG. 7.

The two top layers 15 may comprise at least two wood layers in the longitudinal direction glued on top of each other, respectively.

The grain of a wood layer 10, 12, 13, 15 in the longitudinal direction preferably extends in each case parallel to the mirror plane of the seat shell and the grain of a wood layer 11, 14 in the transverse direction preferably extends in each case transversely to the mirror plane of the seat shell in order to be glued crosswise.

The thickness of the middle wood layers 11 in the transverse direction is preferably 1.4 to 1.8 mm each, particularly preferably 1.5 mm, while the thickness of the middle wood layer 10 in the longitudinal direction is preferably 1.0 to 1.3 mm, particularly preferably 1.2 mm.

Figure 8:
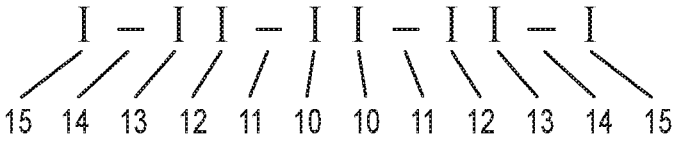

The one middle wood layer 10 in the longitudinal direction may be configured to be dual-layered, as shown in FIG. 8. The thickness of the outer wood layers 14 in the transverse direction and of the outer wood layers 12, 13, 15 in the longitudinal direction may be in the range of 1.0 to 1.3 mm, particularly preferably 1.2 mm. Preferably, the thickness of the outer wood layers 12, 13, 15 in the longitudinal direction is equal to the thicknesses of the outer wood layers 14 in the transverse direction. The thicknesses of the inner 10 and outer 12, 13, 15 wood layers in the longitudinal direction may be configured to be the same.

For reinforcement, textile structures made of synthetic fibres may be laid between the wood layers 10 to 15. The arrangement of the wood layers 11 to 15 is preferably provided on both sides mirror-symmetrically relative to the at least one middle wood layer 10 in the longitudinal direction.

Moreover, it may be provided that the thickness(es) of one or more of the wood layers 10 to 15 is reduced in the direction of the upper and/or lower edge of the shaped wooden shell 1 relative to the transition region 4.

The veneer structure of the shaped wooden shell 1 comprises a plurality of wood layers which are preferably glued crosswise on top of each other is in detail according to FIG. 7 to FIG. 10, as follows.

In FIG. 7, starting from one middle wood layer 10 in the longitudinal direction on both sides are arranged, successively, the middle wood layer 11 in the transverse direction, two outer wood layers 12, 13 in the longitudinal direction, one outer wood layer 14 in the transverse direction and one top layer 15 as the outer wood layer in the longitudinal direction, respectively. This series of veneers is glued together.

In FIG. 8, starting from two middle wood layers 10 in the longitudinal direction on both sides are arranged, successively, the middle wood layer 11 in the transverse direction, two outer wood layers 12, 13 in the longitudinal direction, one outer wood layer 14 in the transverse direction and one top layer 15 as the outer wood layer in the longitudinal direction, respectively. This series of veneers is glued together. The edges of the shaped wooden shell 1 may be provided with a chamfer or is beveled.

Figure 9:
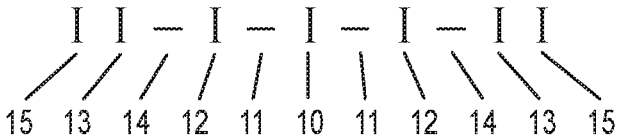

In FIG. 9, starting from one middle wood layer 10 in the longitudinal direction on both sides are arranged, successively, the middle wood layer 11 in the transverse direction, one outer wood layer 12 in the longitudinal direction, one outer wood layer 14 in the transverse direction, one outer wood layer 13 in the longitudinal direction and one top layer 15 as the outer wood layer in the longitudinal direction. This series of veneers is glued together.

Figure 10:
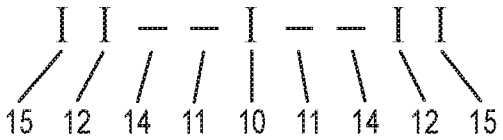

In FIG. 10, starting from one middle wood layer 10 in the longitudinal direction on both sides are arranged, successively, the middle wood layer 11 in the transverse direction, one outer wood layer 14 in the transverse direction, one outer wood layer 12 in the longitudinal direction and one top layer 15 as the outer wood layer in the longitudinal direction. This series of veneers is glued together.

The wood layers 10 to 15 may be produced as shaped plywood parts made from beech. The shaped wooden shells 1 are preferably covered by upholstery or padding, wherein the opening 7 remains as a free space according one embodiment. According another embodiment the transverse slot 8 is covered by padding in order to adjust the seating comfort.

Figure 11:
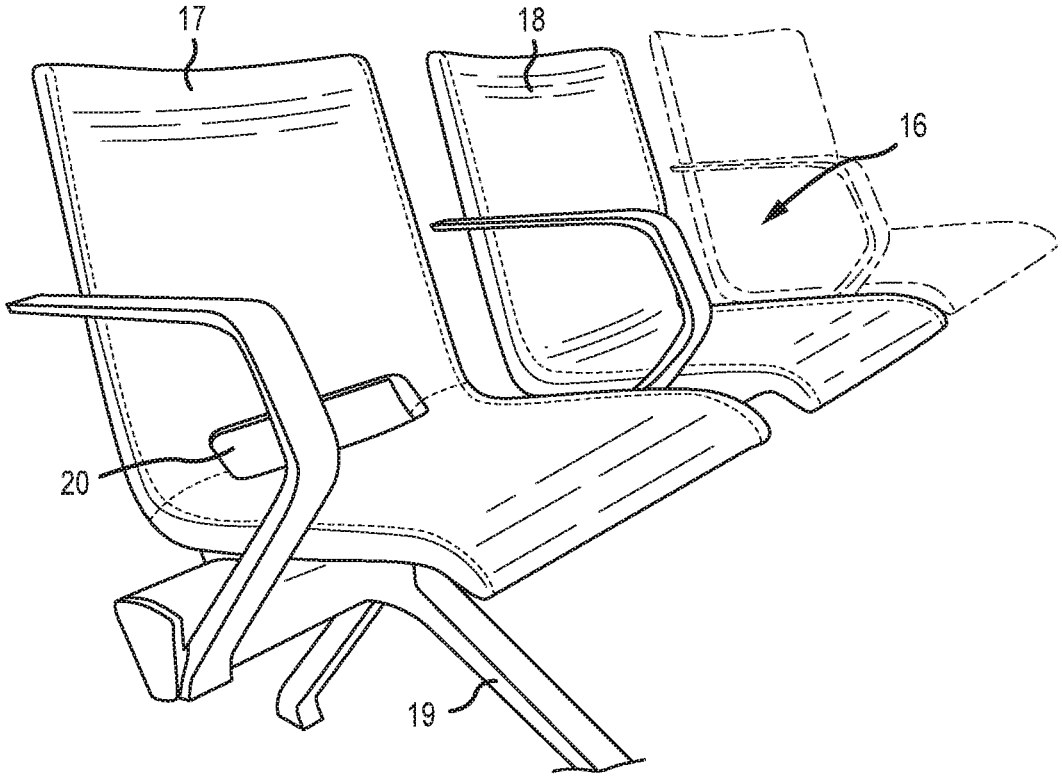
FIG. 11 shows a seat bench having a plurality of seats, in accordance with an embodiment of the invention.

The seat shell with the shaped wooden shell 1 may be provided as a component of a chair or a bench, wherein in the case of a bench a number of seat shells may be fastened to a common frame. For example, FIG. 11 shows a seat bench 16 in accordance with an embodiment of the invention. Seat bench 16 includes two seats 17 and 18 mounted to a common frame 19. Each of seats 17 and 18 preferably includes an upholstered wooden shell. The wooden shells may be of the kind described above. In the example of FIG. 11, seat 17 includes a reach-through opening 20, while any cutout in the wooden shell of seat 18 is upholstered over. In other embodiments, any workable number of seats may be attached to frame 19, in any combination of seat types. For example, all of the seats may include a reach-through opening, or all may have their cutouts upholstered over, or any combination of reach-through and upholstered over seats may be used. In some embodiments, at least some of the seats may be of the type shown and described in U.S. patent application Ser. No. 29/633,847, filed Jan. 16, 2018 and titled "Seat with Lower Cut-Out", the entire disclosure of which is hereby incorporated by reference herein.

The fastening of the individual seat shells to the frame may be implemented in the form of a cantilever in order to provide a resilient frame. Such seat shells are preferably used in waiting areas, for example in airports, cruise terminals, railway and bus stations, public buildings and the like, wherein the number of seats is selectable. According to its intended use, such seat shells may be designed to be stable, in particular since the seats are also regularly misappropriated as sleeping areas or as a shelf for luggage and as a result are subjected to significant loads. The cutout 6, in particular when designed as a reach-through hole, may provide the desired result in preventing use as a shelf.

Finally, such seat shells are also used in smart areas where an attractive design is required. In this case it is also advantageous to prevent undesirable use of the seat shell and namely to provide sufficient stability so that a complex support frame is not required.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A seat shell comprising:

a one-piece curved shaped wooden shell which has a seat part, a backrest part, and a curved transition region between the seat part and the backrest part, wherein the one-piece curved shaped wooden shell has in the curved transition region a bent portion bent along a bending axis and the one-piece curved shaped wooden shell is shaped ergonomically;

suspension properties of the backrest part relative to the seat part, which is angled back and connected to the backrest part, are substantially determined by the curved transition region and a structural design thereof;

wherein the one-piece curved shaped wooden shell comprises a veneer structure, the veneer structure comprising at least nine wood layers glued on top of each other, wherein a first side and a second opposite side of the one-piece curved shaped wooden shell respectively comprise a top wood layer arranged in a longitudinal direction, and between the top wood layers a number of middle and outer wood layers are arranged in the longitudinal direction or a transverse direction such that:

at least two middle wood layers are in a transverse direction, at least one middle layer is in the longitudinal direction and is between two of the middle layers in the transverse direction, an outer wood layer is in the transverse direction, and the at least two middle wood layers in the transverse direction have a thickness greater than the thickness of the outer wood layer in the transverse direction;

wherein the one-piece curved shaped wooden shell is upholstered;

and wherein the one-piece curved shaped wooden shell has a transversely extending cutout defined by bars at an edge in the curved transition region and/or the backrest part.

2. The seat shell of claim 1, wherein at least two outer wood layers in the longitudinal direction are glued on top of each other and are located between one middle wood layer in the transverse direction and one outer wood layer in the transverse direction.

3. The seat shell of claim 1, wherein each of two top layers of the at least nine wood layers comprises at least two wood layers in the longitudinal direction glued on top of each other.

4. The seat shell of claim 1, wherein padding is provided so as to cover the transversely extending cutout in order to continuously upholster the seat shell over a full length thereof, or upholstery is provided around said transversely extending cutout so as to be open as a free space in the upholstery of the seat shell.

5. The seat shell of claim 1, wherein the transversely extending cutout is formed by a double T-bar-shaped transverse slot.

6. The seat shell of claim 1, wherein the transversely extending cutout is configured as a reach-through opening.

7. The seat shell of claim 6, wherein the transversely extending cutout is configured to be rectangular with a length which is 50 to 70% of a width of the seat shell adjacent the transversely extending cutout.

8. The seat shell according to claim 7, wherein the transversely extending cutout has a width which is 20 to 40% of the length.

9. The seat shell of claim 1, wherein a grain of a wood layer in the longitudinal direction extends in each case parallel to a mirror plane of the seat shell and the grain of a wood layer in the transverse direction extends in each case transversely to the mirror plane of the seat shell in order to be glued crosswise.

10. The seat shell of claim 1, wherein the thickness of the middle wood layers in the transverse direction is 1.4 to 1.8 mm, and the thickness of the middle wood layers in the longitudinal direction is 1.0 to 1.3 mm.

11. The seat shell of claim 1, wherein a middle wood layer in the longitudinal direction is configured to be dual-layered.

12. The seat shell of claim 1, wherein the thickness of the outer wood layers in the transverse direction and of the outer wood layers in the longitudinal direction is in a range of 1.0 to 1.3 mm.

13. The seat shell of claim 1, wherein the thickness of the outer wood layers in the longitudinal direction is equal to a thicknesses of the outer wood layers in the transverse direction.

14. The seat shell of claim 1, wherein a thicknesses of the wood layers in the longitudinal direction are the same.

15. The seat shell of claim 1, wherein for reinforcement, textile structures made of synthetic fibres are laid between the wood layers.

16. The seat shell of claim 1, wherein an arrangement of wood layers is provided on both sides mirror-symmetrically relative to at least one middle wood layer in the longitudinal direction.

17. The seat shell of claim 1, wherein a thickness(es) of one or more of the wood layers is reduced in a direction of an upper and/or lower edge of the seat shell relative to the curved transition region.

18. The seat shell of claim 1, wherein the seat shell is a component of a chair or a bench.

19. A seat bench comprising:

a plurality of seat shells according to claim 1; and a common frame to which the plurality of seat shells are fastened.

20. The seat bench of claim 19, wherein the plurality of seat shells being fastened to the common frame is implemented with a cantilever.

21. A seat bench, comprising:

a plurality of seats mounted to a common frame, each of the seats comprising a one-piece shaped wooden shell which has a seat part, a backrest part, and a transition region between the seat part and the backrest part, wherein the shaped wooden shell has in the transition region a bent portion bent along a bending axis, wherein each of the wooden shells comprises a laminated veneer structure, and has a transversely extending cutout defined by bars at an edge in the transition region and/or the backrest part; and wherein the seats are upholstered, and wherein for at least one of the seats, padding is provided so as to cover the cutout in order to continuously upholster the shell over a full length thereof, and for another of the seats, upholstery is provided around said transversely extending cutout so as to be open as a free space in the upholstery of the shell.

22. The seat bench of claim 21, wherein each of the plurality of seats is a seat shell, the seat shell comprising a one-piece curved shaped wooden shell which has a seat part, a backrest part, and a curved transition region between the seat part and the backrest part, wherein the one-piece curved shaped wooden shell has in the curved transition region a bent portion bent along a bending axis and the one-piece curved shaped wooden shell is shaped ergonomically;

suspension properties of the backrest part relative to the seat part, which is angled back and connected to the backrest part, are substantially determined by the curved transition region and a structural design thereof;

wherein the one-piece curved shaped wooden shell comprises a veneer structure, the veneer structure comprising at least nine wood layers glued on top of each other, wherein a first side and a second opposite side of the one-piece curved shaped wooden shell respectively comprise a top wood layer arranged in a longitudinal direction, and between the top wood layers a number of middle and outer wood layers are arranged in the longitudinal direction or a transverse direction such that:

at least two middle wood layers are in a transverse direction, at least one middle layer is in the longitudinal direction and is between two of the middle layers in the transverse direction, an outer wood layer is in the transverse direction, and the at least two middle wood layers in the transverse direction have a thickness greater than the thickness of the outer wood layer in the transverse direction;

wherein the one-piece curved shaped wooden shell is upholstered;

and wherein the one-piece curved shaped wooden shell has a transversely extending cutout defined by bars at an edge in the curved transition region and/or the backrest part.

* * * * *